US005442677A

United States Patent [19]

Golden et al.

[11] Patent Number: 5,442,677

[45] Date of Patent: Aug. 15, 1995

[54] COLD-CATHODE X-RAY EMITTER AND TUBE THEREFOR

[76] Inventors: John Golden, 2859 Sowers Rd., Greensfork, Ind. 47345; Phillip Golden, 196 S. Centerville Rd., Centerville, Ind. 47330

[21] Appl. No.: 142,816

[22] Filed: Oct. 26, 1993

[51] Int. Cl.[6] ..... H05G 1/06

[52] U.S. Cl. ..... 378/102; 378/101

[58] Field of Search ..... 378/101, 102, 103, 106, 378/107, 193, 199, 200, 201, 202, 203

[56] References Cited

U.S. PATENT DOCUMENTS

| | | | |
|---|---|---|---|
| 3,256,439 | 6/1966 | Dyke et al. | 378/102 |
| 3,878,394 | 4/1975 | Golden . | |
| 4,646,338 | 2/1987 | Skillicorn | 378/102 X |
| 4,694,480 | 9/1987 | Skillicorn | 378/102 X |

FOREIGN PATENT DOCUMENTS

| | | | |
|---|---|---|---|
| 0145098 | 8/1983 | Japan | 378/102 |

OTHER PUBLICATIONS

The Institution of Electrical Engineers—vol. III, "Novel Principle of Transient High-Voltage Generation"—V. T. S. Howell, Apr. 1964.

Film and Paper Radiography, "Fluorescent Screens", No Date.

*Primary Examiner*—David P. Porta

*Attorney, Agent, or Firm*—Young, MacFarlane & Wood

[57] ABSTRACT

A light weight battery powered x-ray source capable of producing high intensity x-ray emissions with low power consumption. A modular construction locates all high voltage components including the x-ray tube, spark gap trigger, spiral capacitor and the secondary of a step-up transformer in a sealed canister which can be decoupled both mechanically and electrically by unscrewing a simple threaded coupling. A center module contains the primary of the step-up transformer, circuit boards for electronic components and a pulse counter/selector. A battery pack with rechargeable Nicad batteries is removably connectable to the center module. High intensity pulses are achieved in part by connecting the spiral capacitor at midlength to the spark gap trigger. An improved x-ray tube with light weight but effective lead shielding and an overall length of less than two inches is also disclosed.

16 Claims, 7 Drawing Sheets

COLD-CATHODE X-RAY EMITTER AND TUBE THEREFOR

FIELD OF THE INVENTION

This invention relates to cold-cathode x-ray emission sources and particularly to a battery powered portable x-ray source of extraordinarily light weight capable of producing high intensity x-ray pulses having the penetrating power normally .associated only with larger, higher power consumption sources.

BACKGROUND OF THE INVENTION

In U.S. Pat. Nos. 3,878,394 and 3,970,884 there is disclosed a portable x-ray emission source suitable for radiographic uses. Products incorporating the inventions of the aforesaid patents have been manufactured for approximately 20 years by Golden Engineering, Inc. of Centerville, Ind. and sold under the registered mark "THE INSPECTOR." These products typically weigh about 20 pounds with battery pack, can be operated on either ac or dc current and are small and light enough to be easily transported from place to place.

As is more fully described in the aforesaid U.S. patents, a portable x-ray emitter of the type to which this patent and the previous patents relate comprises the combination of a battery pack, an inverter for generating a time varying or ac signal quantity, a voltage step-up transformer having primary and secondary windings, a rectifier for converting the secondary winding voltage of the transformer back to dc, a capacitive charge generator, a trigger and a cold-cathode x-ray emitter tube connected to receive the voltage transient generated by the combination of the capacitive charge generator and the trigger. Because the device is operated in a pulsed rather than continuous mode, it is capable of generating a series of x-ray emission pulses, preselectable in number, of high intensity and high penetrating capability with small electrical power dissipation.

We have now found it possible to provide an x-ray emission source of the pulsed emission type which is markedly smaller and lighter than the above-mentioned produce, yet suitable for producing high intensity x-ray emission pulses or bursts of high penetration capability. The subject x-ray source is suitable, for example, for the excitation of radiographic image intensifier screens of the type which are commercially available at the present time, using the power available from only a relatively small and lightweight rechargeable battery pack.

Through the design and construction of such a device we have found it possible to increase the utility of portable x-ray emission sources by substantially decreasing the size and weight thereof without sacrificing effectiveness or x-ray emission penetration capability. By way of example we have found it possible to reduce the weight of a portable dc x-ray emitter by about 70% relative to the predecessor product described above without sacrificing penetration capability.

SUMMARY OF THE INVENTION

In general our invention is embodied in a lightweight portable x-ray emitter the fundamental components of which are as categorically described above in reference to the predecessor device; i.e., the present invention is preferably embodied in a device having a dc battery pack, an inverter, step-up transformer, rectifier, charge generator, trigger and cold-cathode x-ray tube. However numerous of those components are substantially revised as hereinafter described to produce not only a substantial weight and power consumption reduction without sacrificing penetration capability but also providing the further benefits of improved reliability and serviceability.

In accordance with a first aspect of the invention reliability and serviceability of a cold-cathode, battery powered portable x-ray emitter is significantly improved through the arrangement and location of principal components into structural modules, one of which contains as an integrated unit all of the high voltage components including the x-ray tube, charge generator, spark gap trigger, rectifier and the high voltage side of the step-up transformer. All of the remaining low voltage components are arranged in a separate structure which may itself be subdivided into two or more modules as hereinafter described. In accordance with the invention the high voltage and low voltage modules are mechanically coupled to one another in such a way that the high voltage module may be decoupled or disconnected mechanically from the low voltage components without tools and replaced in the field in the event service is necessary without first going through a careful and/or hazardous discharge procedure and with no risk of shock or injury to the user. Additional high voltage modules may be carried as spares and interchanged with a non-functional module as easily as changing a light bulb.

In the preferred form, the modular construction concept is carried to the point of defining three modules; i.e., the aforesaid high voltage module which preferably is housed within a metal canister, an interface module the principal support components of which can be molded plastic, and a battery pack which may be designed to carry a power switch and which is rechargeable in a conventional manner. Whereas the interface and battery pack modules may, in addition to a mechanical coupling, require sliding contact electrical connections to integrate the several electrical components thereof, the interface and high voltage modules are electrically connected to one another only through the electromagnetic coupling between the low voltage primary and high voltage secondary sides of the step-up transformer. Accordingly, no sliding contacts or other hard wired terminal components are required and the respective ferrous metal cores of the primary and secondary sides of the transformers may be designed to be complemental in nature; i.e., mating in face to face relationship along an axis of symmetry which is central to a threaded coupling for packaging efficiency.

In the preferred form the subject device includes a mechanism for the selection of any number of x-ray emission pulses or bursts to be produced in any single actuation depending upon the degree of penetration and exposure required by a given application. In the preferred form, a presettable pulse or x-ray burst counter is provided in the low voltage structure and is counted back to zero as the device fires. While the counter function requires sensing the actual number of x-ray pulses produced in the high voltage module, the sensing circuitry may be electromagnetic in nature, combined with the step-up transformer windings and, therefore, require no terminals or sliding contacts between the high and low voltage modules or structures of the subject device.

According to a further aspect of the invention, the intensity and penetration power of the x-ray pulses or emission bursts is maintained while at the same time the power dissipation requirements are reduced relative to the predecessor device through the redesign of the charge generator. More specifically, the charge generator, like our predecessor product, is manufactured by spirally wrapping two foil capacitor "plates" in a concentric fashion and interleaved with layers of dielectric material such as paper and a polyester film such as Mylar. However, the electrical interconnection between the spiral wrapped capacitive charge generator and the tungsten electrodes of the spark gap trigger are taken from a point approximately midlength on the capacitor foils rather than from the ends thereof as was previously the case. This midlength electrical connection from the capacitor plates to the electrodes of the spark gap trigger substantially shortens the capacitor discharge time and produces high voltage transients of high intensity albeit short length which, when applied to the tube, contribute beneficially to the intensity and penetration capability of the x-ray emissions which are produced by the subject device.

In accordance with still another aspect of the present invention an x-ray emitter tube has been designed and produced which is of dramatically reduced size and length and which requires substantially less internal shielding material and is, therefore, substantially reduced in weight. The tube of the subject device, like the tube described in U.S. Pat. No. 3,970,884, is of the cold-cathode type and preferably employs a rod like anode of tungsten having a sharpened emitter end and a blunt opposite end, together with one or more annuli or rings of woven graphite disposed about but in spaced relationship with the sharpened end. In accordance with the present invention the x-ray emitter tube further comprises a shielding cylinder of lead or the like disposed about the sharpened end, a shielding plate of lead or the like disposed about the blunt end of the anode rod and a glass envelope of reentrant shape hermetically encapsulating the aforementioned structure, the reentrant shape being radially outwardly of the sharpened emitter end of the anode and sealingly contacting a holder structure for the cathode ring or rings. Through this design we have been able to achieve well shielded and highly effective x-ray emissions in tubes which are no more than about two inches in length.

The various aspects of the present invention may be best understood by reference to a specific and illustrative embodiment of the invention which is hereinafter described with reference to the following drawings.

BRIEF DESCRIPTION OF THE DRAWING

FIGS. *6a, 6b, 6c* and *6d* are illustrative schematic circuit diagrams for the device of FIG. 1.

DETAILED DESCRIPTION OF THE PREFERRED EMBODIMENT

Figure 1:
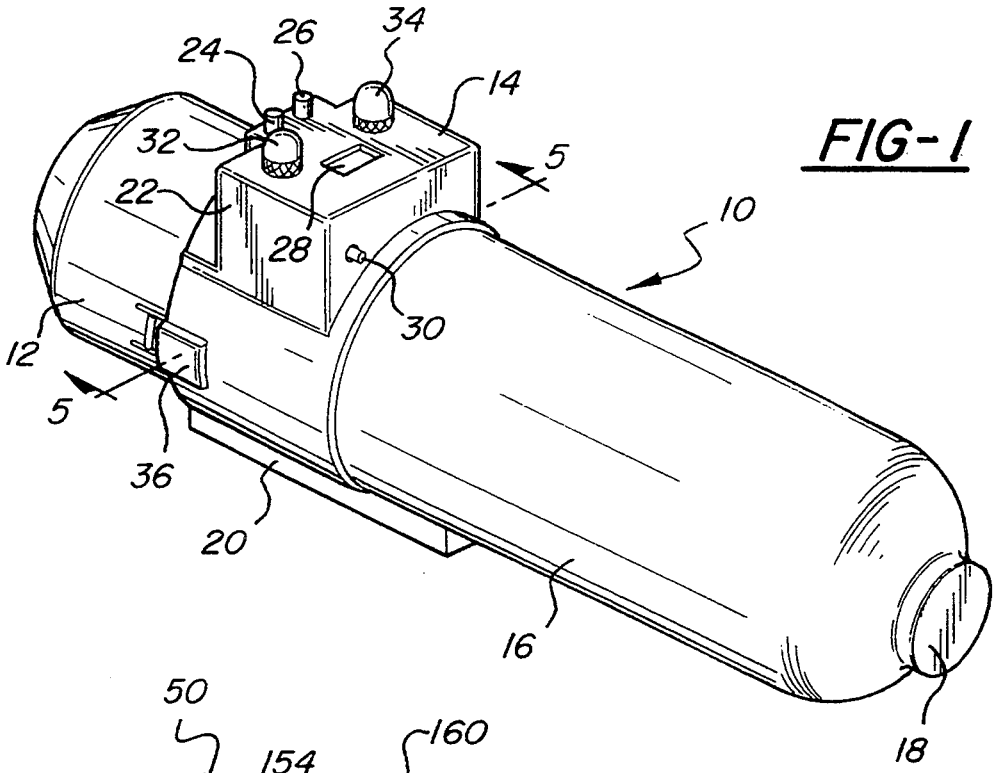
FIG. 1 is a perspective view of an illustrative embodiment of the invention.
Figure 4:
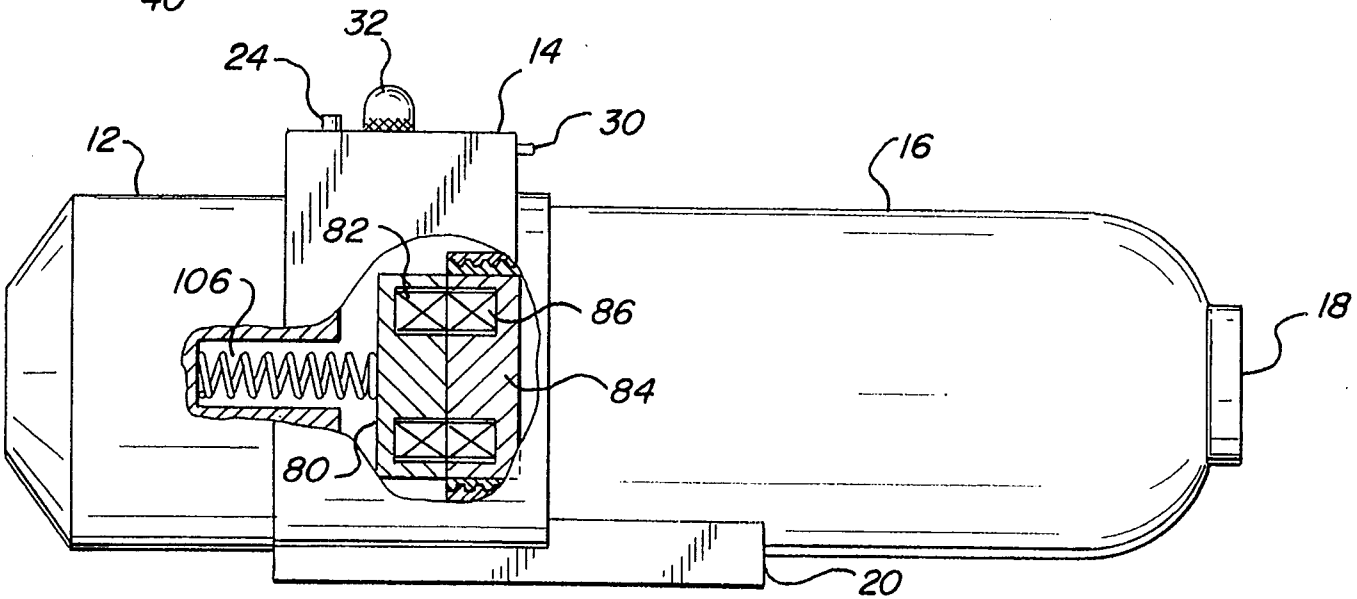
FIG. 4 is a side view partly in section showing the manner in which the step-up transformer of the device of FIG. 1 is constructed.
Figure 3:
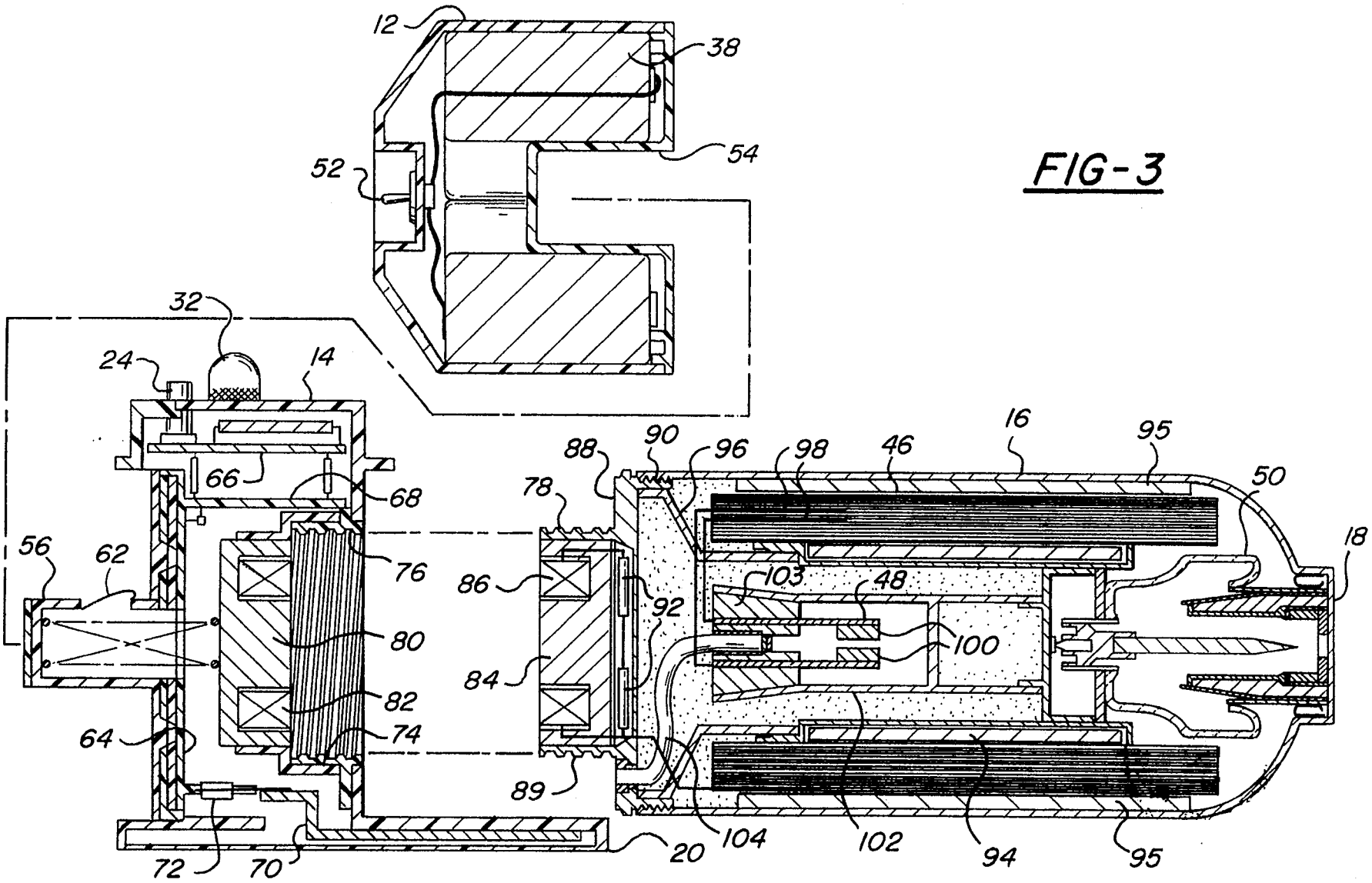
FIG. 3 is an exploded side view in section of the device of FIG. 1 showing the modular construction thereof.

Referring now to the drawing and first to FIGS. 1, 3 and 4, an illustrative embodiment of the invention is shown in the form of a small lightweight battery-powered x-ray emission source 10 having as integrated but separable components thereof a battery module 12, an interface module 14 and a high voltage canister module 16 having an integral metallic emission window 18 at the distal end thereof. Battery module 12 and interface module 14 have external molded plastic structural components whereas the external structure of canister is metallic and, preferably, aluminum. Interface module 14 provides an integral molded plastic base 20 which permits the source 10 to be placed on a flat working surface or attached to a tripod or the like. Above the base 20 and integral with the interface module 14 is a user interface tower 22 carrying pulse count selector push-buttons 24 and 26 which are capable of setting the 1's and 10's digits into the window of a two-digit display 28 to show the number of x-ray pulses to be generated when the source 10 is powered up. A trigger button 30 is pressed to initiate the emission of x-ray pulses. Power ON and emission-in-progress lights 32 and 34 are mounted atop the tower 22. A remote trigger input (not shown) may also be used to permit the operator of the source 10 to retire to a safe distance during x-ray emission.

In accordance with the modular concept described herein, the interface module 14 and the battery module 12 are provided with a pair of diametrically opposed manually-operable ratchet couplings to permit the battery pack to be connected to and disconnected from the interface module 14 by simple manual manipulation; i.e., by squeezing the opposite ratchet couplings 36 inwardly and without the use of tools. As hereinafter described, the canister module 16 preferably takes the form of an aluminum canister which is mechanically coupled to the interface module 14 by means of a simple axial threaded coupling described in greater detail with reference to FIG. 3.

Figure 2:
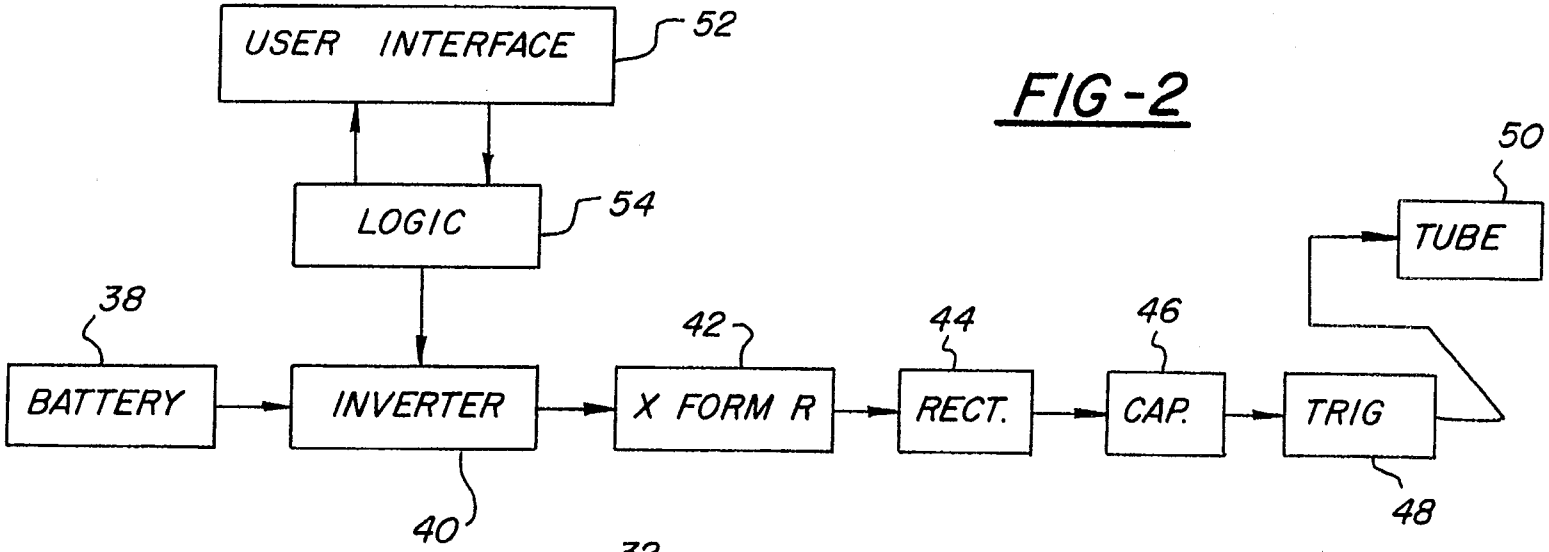
FIG. 2 is a block diagram of the major components of the device of FIG. 1.

Referring now to FIG. 2, the principal components of the operating system of the source 10 are shown to comprise a pack 38 of nickel cadmium rechargeable batteries. In the illustrative embodiment battery pack 38 comprises an six Nicad batteries epoxy-bonded into a cylindrical cluster and securely disposed within the molded plastic housing of the battery module 12 symmetrically radially disposed about the longitudinal axis of symmetry of the module 12 and the overall device 10 in the assembled form. The individual batteries 12 are connected in series to provide a 7.2 volt DC power supply. The output of the battery pack 38 is connected through a switch 52 to power an inverter 40 which produces an alternating current quantity suitable for application to a step-up transformer 42. The transformer 42 has a low voltage primary coil carried by the interface module 14 and a high voltage secondary voltage coil carried by the canister module 16. The high voltage output of the transformer 42 is converted back to DC by rectifier bridge 44 and applied to the capacitor plates of a spirally-wrapped charge generator 46. The charge generator is connected in turn to a spark gap trigger 48 having spaced tungsten electrodes which in turn are connected in parallel with the anode and cathode of a cold-cathode x-ray emission tube 50 located in the canister module 16 immediately adjacent the integral aluminum window 18. The display 28, count-select push-buttons 24,26, trigger switch 30 and lights 32,34 are collectively represented at 52 in FIG. 2. The electronics components of interface module 14 are represented at 54.

Figure 5:
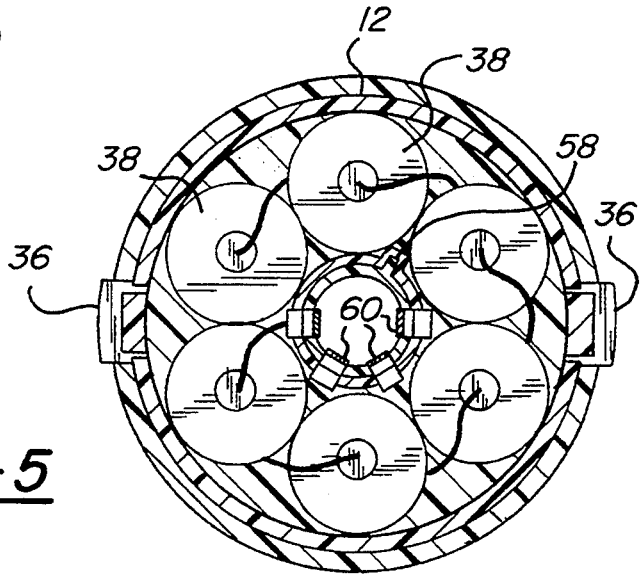
FIG. 5 is an end view of a rechargeable Nicad battery pack constituting one of the modules of the device of FIG. 1.

Referring now to FIGS. 3, 4 and 5, the structure of the device of FIG. 1 will be described in greater detail.

The battery module 12 comprises a generally cylindrical and sealed plastic housing carrying the six Nicad batteries in a cylindrical cluster and potted or otherwise secured within the plastic molding of module 12 so that they do not rattle or move around during operation or transportation of the source 10. A power switch 52, shown in FIG. 3 as a toggle switch but susceptible of various implementations including, for example, a key-operated master switch for security purposes, is connected to and between the batteries 38 and the subsequent circuitry to be described to permit the device to be turned on and off. The battery module 12 is coupled to the interface module 14 by means of a female socket 54 formed centrally and longitudinally of the battery module to receive a male mounting peg 56 which extends outwardly from the interface module 14 along the axis of symmetry thereof. As best shown in FIG. 5, a key/keyway combination 58 is molded into the male and female components of the mechanical mount 54,56 to ensure proper alignment thereof during assembly, such alignment being necessary to ensure proper connection between sliding spring terminals 60 and 62 carried by the battery module 14 and the male peg 56 of the interface module 14 as shown. The spring contacts complete the electrical circuitry between the batteries 38, switch 52 and additional circuitry which forms part of the interface logic 54 and the inverter 40 described with reference to FIG. 2.

Interface module 14 is further illustrated in FIG. 3 to comprise a molded plastic housing having appropriately secured therewithin circuit boards 64, 66 and 68. Board 64 is designed to carry the components of the inverter circuit 40 as hereindescribed in detail with reference to FIG. 6. The base 20 of the interface module 14 housing makes a convenient location for a metal heat sink 70 which is thermally connected to dissipate heat from switching transistors 72 which form part of the inverter circuit 40.

Cylindrical plastic moldings 74 and 76 are bonded together and mounted within the outer housing of the interface module 14 along the axis of symmetry thereof to provide a sliding receptacle for a low voltage transformer core 80 and an internally threaded mechanical coupling for joining the interface module 14 to the canister module 16; i.e., the canister module is provided with a molded plastic end fitting 88 having external threads 78 complemental with the internal threads of the molded plastic coupling 76. The structural molding 88 exhibits a reduced diameter portion 89 of cylindrical shape to form on the external surface thereof the thread 78 and to provide within the internal surfaces thereof the mounting location for the core 84 of the high voltage side of the transformer 42. The low voltage transformer coil is shown at 82, and the high voltage secondary coil of the transformer is shown at 86.

The large diameter flange portion 90 of the molded plastic structural fitting 88 is threaded to receive in mechanical engagement therewith the aluminum canister 16 of the canister module, the threaded coupling 88,90 being bonded for relative permanence such that the threaded coupling 76,78 is operative with lesser turning torque than the coupling 88,90; i.e., while it is desirable to be able to disassemble the entire canister unit 16 from the interface unit 14 via threaded coupling 76,78 during normal field operations of the source 10, it is not desirable or expected that the threaded coupling 88,90 will be decoupled in the field. Rather, it is the intent of this structure that the entire canister module 16 be viewed as a non-serviceable block for replacement purposes in the field. Canister modules 16 may, of course, be rebuilt and/or serviced by the manufacturer.

Diodes 92 are connected to receive the high voltage signal quantity from the transformer secondary coil 86 and form the rectifier bridge 44 shown in FIG. 2. These diodes are in turn connected to the spiral capacitor 46 which is of wrapped spiral design mounted around ferrite bars 94 on a bobbin 96 which is bonded to the end fitting 88. The spiral capacitor 46 generates a high voltage charge between two spaced apart copper foil capacitor plates that are interleaved with alternating layers of paper and Mylar film, the dielectric properties of which are suitable for use in making high voltage spirally-wrapped capacitors. The copper foil plates of the capacitor 46 are connected midlength to leads 98 which are in turn connected electrically to the tungsten electrodes 100 of a spark gap voltage-sensitive trigger 48 whose function it is to discharge the charge generator 46 across the anode and cathode of the x-ray emitter tube 50 shown in FIG. 3 to be mounted adjacent the emitter window 18. The spark gap trigger electrodes 100 are disposed within the chamber formed by plastic molding 102 within the aluminum canister 16 and isolated therefrom by means of an epoxy seal 103.

In the embodiment of FIG. 3, the interior of the chamber for the tungsten electrodes 100 of the spark gap trigger 48 is vented by tube 104 passing through the end wall 88 to the atmosphere. In an alternative embodiment, the chamber formed by molding 102 is sealed entirely and filled with pressurized air to provide excess air so that the gradual reduction in air pressure within the trigger chamber caused by oxidation during discharge offsets the effects of the increased spacing between the tungsten electrodes 100 which results from the throwing off of tungsten particles during the high voltage discharge. Accordingly, the excess air, high pressure sealed chamber is shown to exhibit the desirable characteristics of relatively constant voltage discharge point across the useful life of the trigger 48. A second set of ferrite bars 95 is arranged around the capacitive charge generator 46.

The inner chamber formed by the combination of canister 16 and the end fitting or molding 88 is preferably filled with an oxygen of $SF_6$ but may for heavy-duty purposes be filled with other breakdown-resistant fluids such as oil.

As previously described, one primary advantage of the subject device is the modular construction thereof, and the fact that all of the high voltage components of the operating system shown in FIG. 2 are carried in the canister module 16. These modules include the transformer secondary coil 86, the rectifier 42, the spiral capacitor charge generator 46, trigger circuit 48 and the tube 50. For use in the field, a spare new or rebuilt high voltage canister module 16 may be carried along with an otherwise fully assembled source 10 and in the eventuality of a breakdown in one of the components of the high voltage canister module 16 which signals the end of the useful life of this module, the source 10 can be shut off by means of the power switch 52 and, without the necessity for a discharge routine, the canister unit 16 may be decoupled both mechanically and electrically from the interface module 14 and the battery module 12 simply by rotating the canister module 16 about the longitudinal axis thereof to decouple threaded coupling 76,78. A new high voltage canister module 16 may be then threaded back into the previous assembly as simply as one might change a light bulb. The unit can then be reactivated and x-ray inspection operations continued with minimal delay.

As shown in FIG. 4, the low voltage primary core 80 of the transformer 42 is slidably movable within the housing 74 of the interface unit and is urged axially toward the high voltage core 84 for face-to-face contact thereof by means of a spring 106 which extends into the male peg 56 which forms part of the mechanical coupling between the battery of module 12 and the interface module 14 as previously described. The length of the spring 106 is such that it does not urge the core 80 all the way out of the confining mounting structure 74 but does permit sufficient spring travel to ensure that the flat mating faces of the ferrous metal cores 80 and 84 are in effective contact with one another when the canister unit 16 is mechanically coupled to the interface unit 14 as previously described.

Figure 6A:
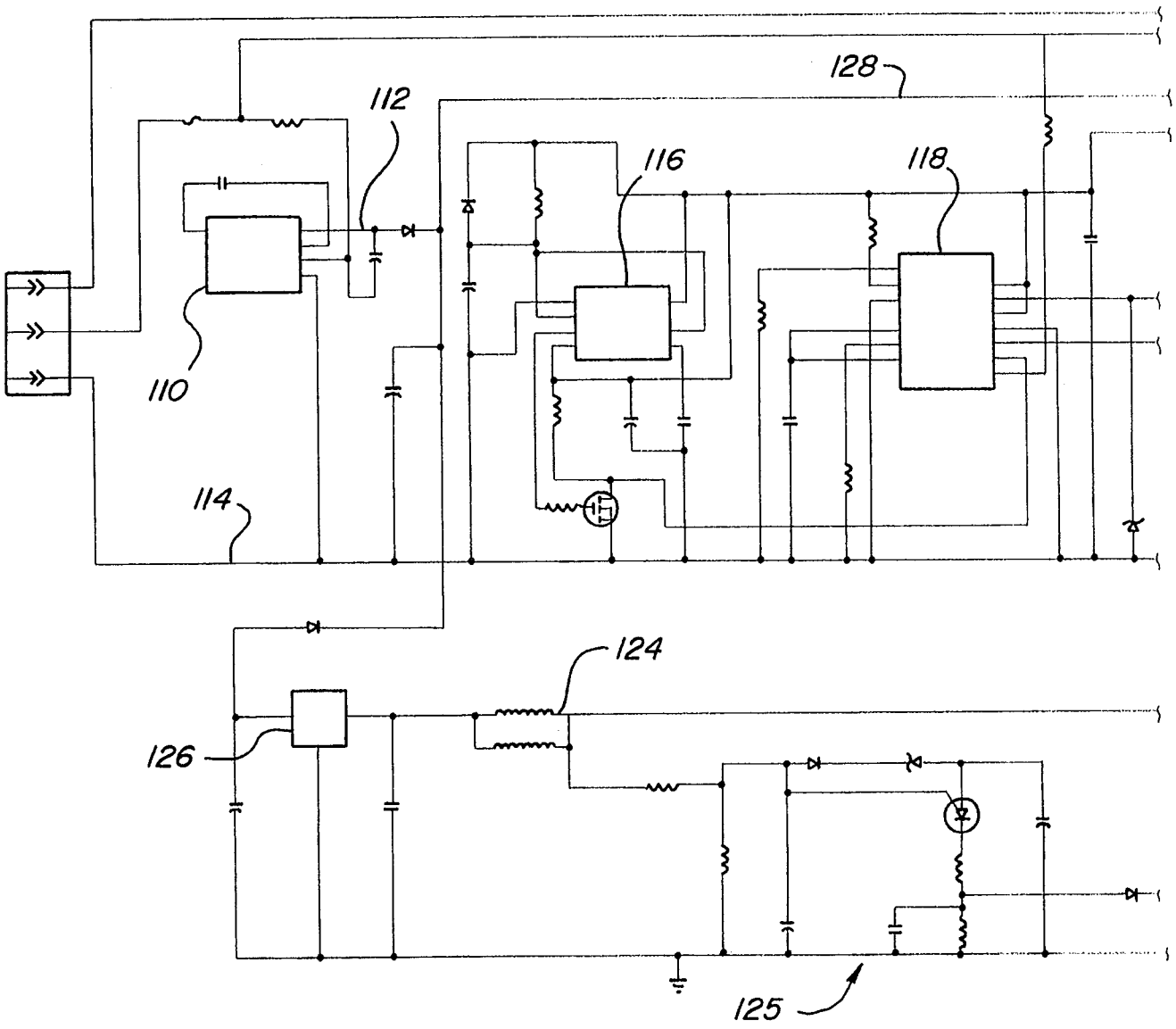
Figure 6B:
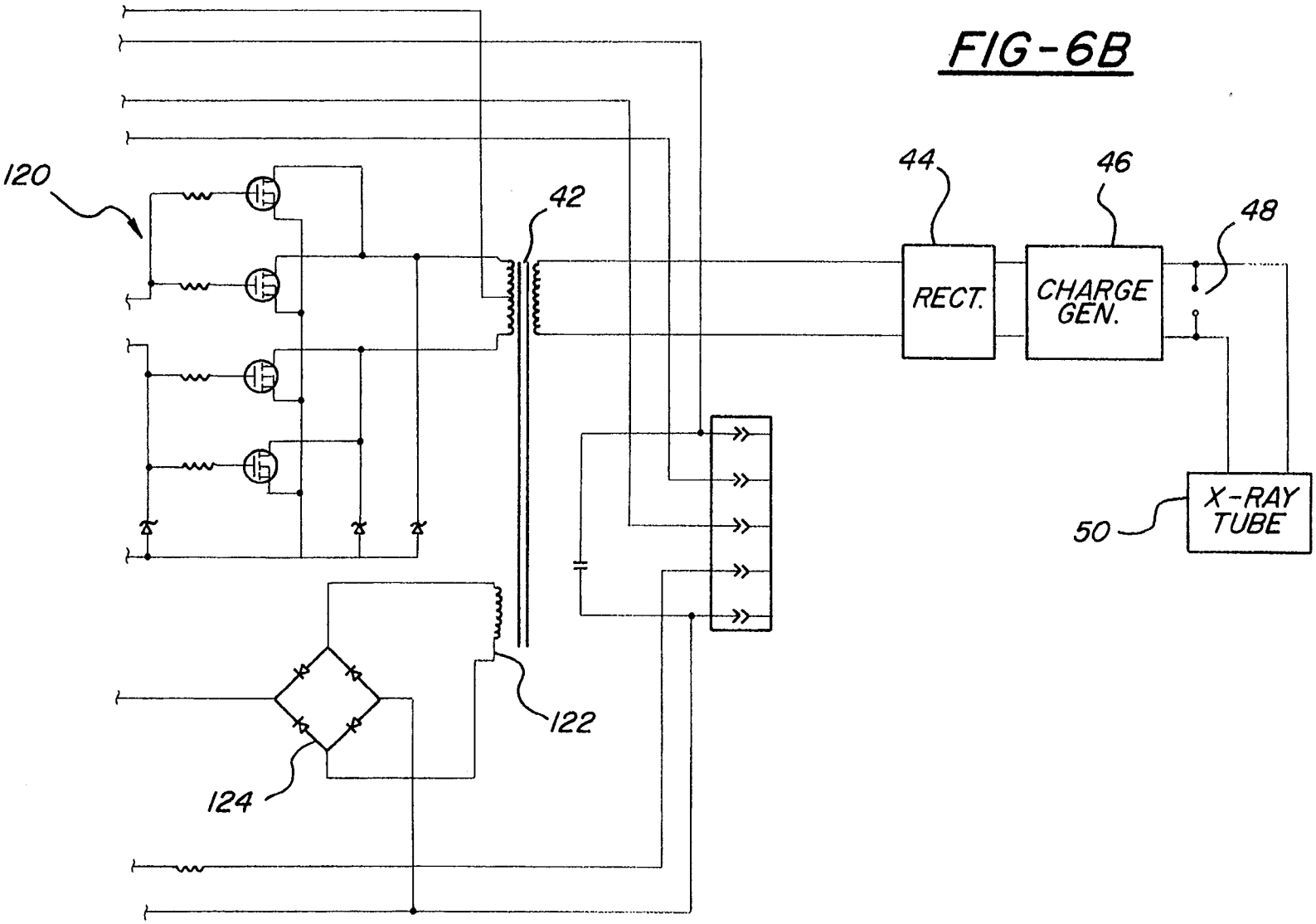

Looking now to FIGS. 6*a* and 6*b*, circuit 110 is a voltage stepper providing a 12-volt output on line 112 and a 7.2-volt regulated output on line 114. Circuit 116 is a primer which limits operation of the source 10 to 50 seconds; i.e., it is an automatic turn off function not subject to external override. Circuit 118 is an oscillator which forms part of the inverter 40 and which drives MOSFET devices 120 to energize the low voltage primary side of transformer 42. As shown in FIG. 6*b*, the secondary winding of the transformer 42 is rectified at 44 and applied to the capacitive charge generator 46, the discharge of which is produced by spark gap trigger 48 to excite the x-ray emitter tube 50.

As also shown in FIG. 6*b*, a feedback winding 122 is wound on the low voltage primary side core of the transformer 42 to pick up electromagnetically the transients produced by discharge of the charge generator capacitor 46. These discharge pulses produce a voltage transient in the winding 122 which is rectified by diode bridge 124 and used to activate a counter-pulse generator 125. Pulses from the generator 125 are applied through noise filter 124 to a 12-volt regulator (Motorola) and thereafter to count down the counter circuit display as described above.

Figure 6C:
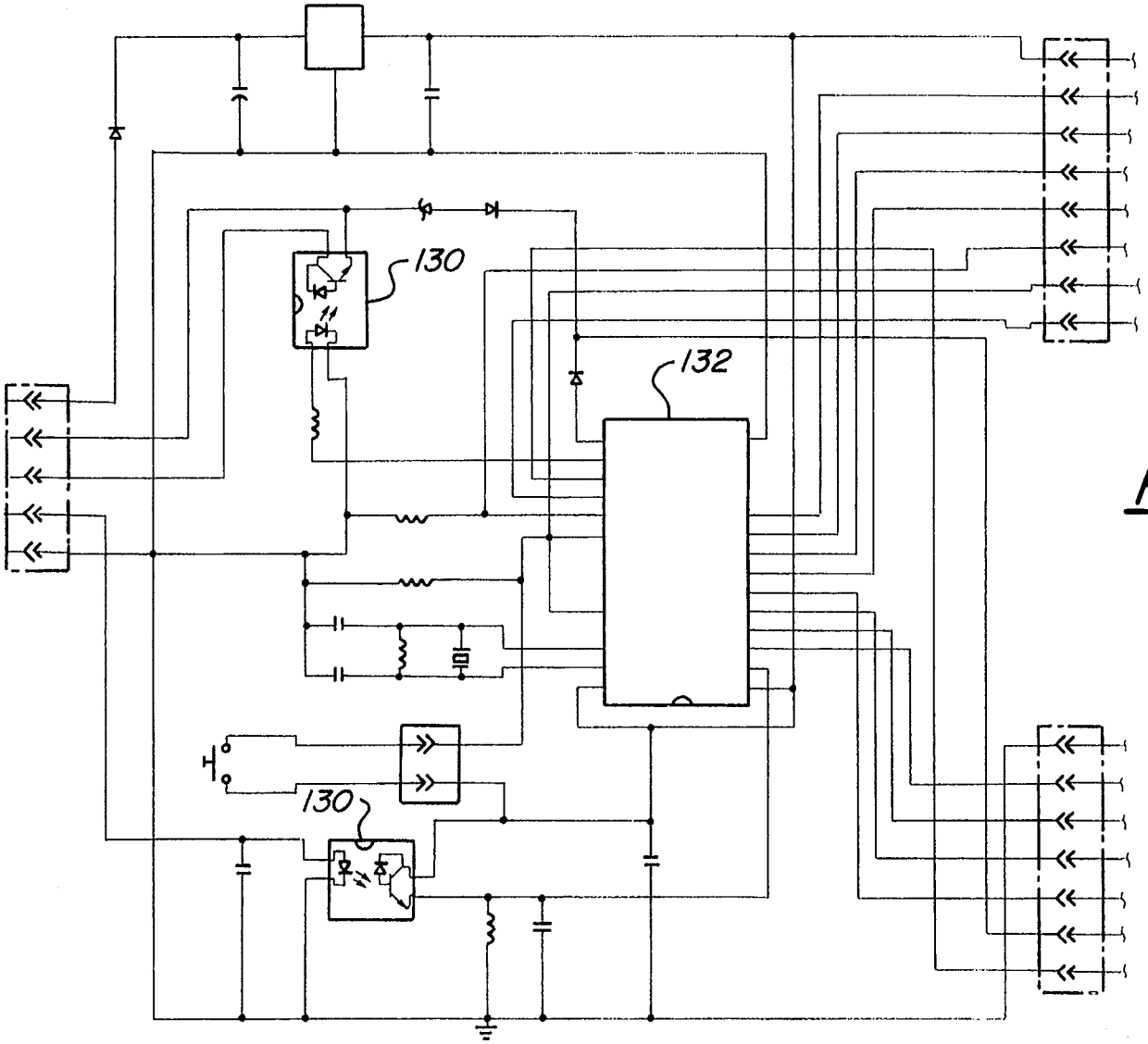
Figure 6D:
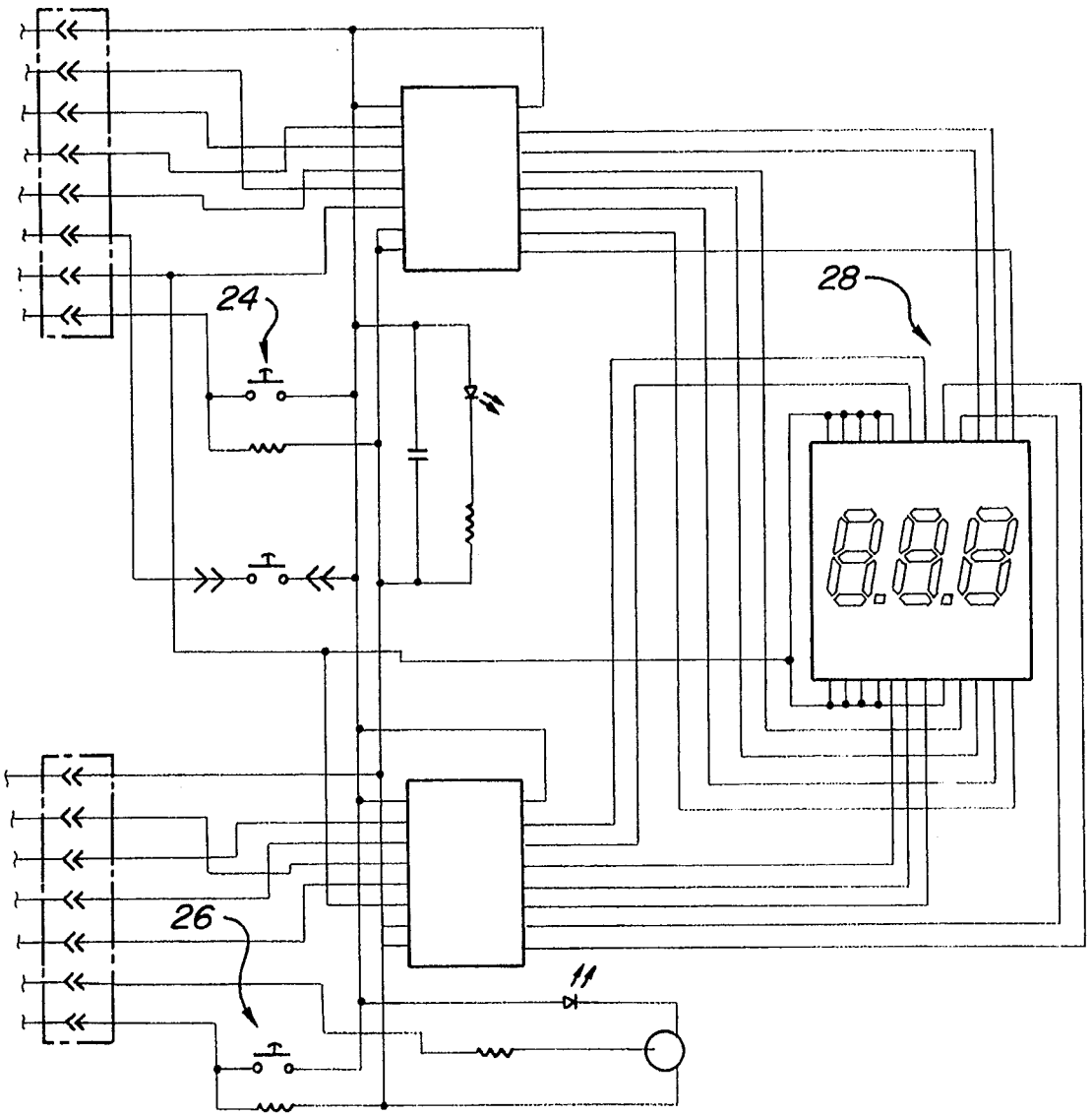

Referring to FIG. 6*c*, the remaining portions of the circuitry are shown to comprise optical couplers 130 and a microprocessor 132 which operates the 1's and 10's digits of the display 28 shown in FIG. 1. FIG. 6*c* also shows the push-button switches for setting the display counter and for triggering the device for instantaneous or delayed activation. It will be understood that the circuitry shown in FIGS. 6*a, b, c* and *d* although preferred and usable in a device of the character described herein, is illustrative in nature and that various other circuit and circuit arrangement compatible with the objectives of the present invention may also be used.

Figure 7:
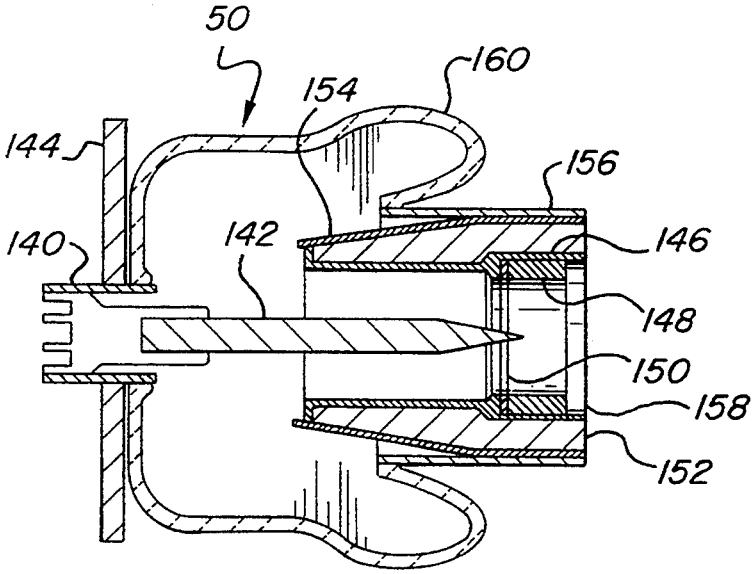
FIG. 7 is a side sectional view in detail of an improved x-ray tube which is usable in the device of FIG. 1.

Referring now to FIG. 7, the x-ray tube 50 is shown to comprise a Kovar metal cylinder 140 which provides a mounting for a rod-like tungsten anode 142 of just over one inch in length. The anode exhibits a sharpened emitter end to the right as shown in FIG. 7 and a blunt mounting end to the left. A disk-shaped lead shield 144 is disposed around the mounting cylinder 140 adjacent the blunt end of the anode 142 and is approximately $1\frac{1}{2}$ inches in diameter to prevent x-ray emissions from traveling backwardly and outwardly from the sharp emitting end of the anode 142. Stainless steel cup 146 and washer 148 secure a woven graphite cloth cathode 150 in coaxial but spaced relationship with the emitting tip of the anode 142. A tapered lead cylinder 152 is secured between the outside surface of the stainless steel mount 146 and the inside surface of a frusto-conical stainless steel cylinder 154 which in turn is mounted within a Kovar metal cylinder, the temperature coefficient of expansion of which, like that of cylinder 140, is matched to the material of the glass envelope 160 which extends from the left end as shown in FIG. 7 to the right end where it is attached to Kovar cylinder 156. The glass envelope 160 increases in diameter outwardly toward the front or right end as shown in FIG. 7 and is formed into a reentrant curve to provide a large internal volume outboard and surroundingly of the emitting end of the anode 142. A nickel window 158 is bonded into the stainless steel components 146 and 148 and butts up against the inside surface of the integral aluminum window 18 of the canister module 16 as shown in FIG. 3. The tube 50 is evacuated and sealed.

The lead shield 152 provides protection against radially outwardly traveling x-ray emissions including those which travel at right angles to the emitting tip and those which travel more rearwardly toward the interface module 14. This protects the user and prevents decomposition of the glass envelope which causes a loss of insulation efficiency. Because the effectiveness of the shielding is a function of the distance the x-rays must travel to pass through the shielding, the angle traveled by those x-ray emissions passing more rearwardly through the lead shield 152 is such that the material may be tapered toward the left end without loss of effectiveness; i.e., the effective radial thickness of the shield to an x-ray which travels rearwardly at an angle through the tapered area is just as great as the effective thickness of shielding experienced by an x-ray emission traveling directly radially outwardly at right angles through the non-tapered section of the shield 152.

The shape of the glass and the location of the lead shielding is such as to protect the glass as described above, reduce internal tungsten deposits from decomposition of the anode and provide an electron trap which enhances x-ray emission efficiency.

INDUSTRIAL APPLICABILITY

In practice, the device described with reference to FIGS. 1–7 hereof may be used in the field for the purpose of inspecting luggage, packages, animal carcasses and various other objects with respect to which a non-destructive inspection of the contents thereof is desired. The typical practice involves the use of the subject source 10 to penetrate the object or package to be inspected and thereafter to impinge upon the active surfaces of an image intensifier screen of a type commercially available from the Polaroid Corporation. The illumination which is produced in the intensifier screen is in turn used to activate photographic film; again a suitable product is available from the Polaroid Corporation.

In a typical operation the source 10 would be placed on a tripod or other suitable stable surface and aim toward the object to be penetrated. The image intensifier screen and film package are disposed along the line of sight of the source 10 with the object to be inspected between them. A number of pulses for suitable penetration of the object and exposure of the film by way of the image intensifier screen is selected by means of the push-button after the device is powered up by means of the switch 52. The source 10 may then be activated by means of switch 30 and the counter is counted back to zero. The lights indicate to the user that power is ON and ultimately that the operation source to irradiate the object under scrutiny was satisfactorily achieved. The film is then allowed to develop and is viewed in the normal way.

Should one of the high voltage components of the source 10 reach the end of its useful life during a field operation, the high voltage module 16 may be unscrewed from the interface of module 14 simply by turning the cylindrical canister 16 about its longitudinal axis of symmetry. The threaded coupling is such as to permit simple mechanical disk connection of the high voltage canister module 16 and the split core of the transformer 42 is such that full removal of all high voltage components is achieved without the need for special discharge procedures. A new canister module 16 may then be threaded into place and operations continued with minimum delay.

The battery module 12 may be recharged in conventional ways using a simple adapter which emulates the shape and contact configuration of the male peg 56 of the interface module 14.

We claim:

1. A lightweight, battery-powered X-ray source of the type which comprises a DC power pack, an inverter powered by the DC power pack to produce an AC quantity, a step-up transformer having a low voltage coil connected to receive the AC quantity and a high voltage coil for producing a high voltage AC quantity when electromagnetically coupled to the low voltage coil, an X-ray tube, a charge generator connected to receive the high voltage quantity after rectification and a trigger connecting the charge generator to the tube for excitation thereof wherein the source further comprises:

(a) a first structure containing said power pack, said inverter and said low voltage transformer coil and electrically connected as a functional unit; and (b) a second structure containing said X-ray tube, said charge generator, said trigger and said high voltage coil electrically connected as a functional unit;

said first and second structures including complemental mechanical coupling means operative to releasably mechanically couple the two structures together and simultaneously to electromagnetically couple the high and low voltage transformer coils.

2. Apparatus as defined in claim 1 wherein the low voltage transformer coil is wound on a first core portion and the high voltage coil is wound on a second core portion, said first and second core portions being mounted in the respective first and second structures so as to be brought into registry when the complemental mechanical coupling means are physically joined.

3. Apparatus as defined in claim 1 further including counter means carried by the first structure and a transformer signal coil electromagnetically associated with the low voltage coil for operating said counter means according to the number of pulsed excitations of said X-ray tube.

4. Apparatus as defined in claim 1 wherein said first structure further comprises a battery module containing said power pack and an electronic module containing said low voltage transformer coil, said apparatus further comprising first means mechanically releasably coupling said battery and interface modules and second means including mating contact means for electrically connecting said power pack to said coil when said modules are mechanically coupled and disconnecting said power pack from said coil when said modules are mechanically decoupled.

5. Apparatus as defined in claim 4 further including a power switch carried by said battery module for switching power on and off from said power pack to said oscillator.

6. Apparatus as defined in claim 1 wherein said second structure comprises a metal canister having an x-ray emitter end and an axially threaded coupling opposite said emitter end, said first structure having a threaded coupling complemental with said canister coupling.

7. Apparatus as defined in claim 6 wherein said high and low voltage transformer coils are wound on respective first and second ferrous metal cores, said high voltage core being disposed axially within and surrounded by said axially threaded canister coupling.

8. Apparatus as defined in claim 6 wherein said canister defines a first chamber within the interior thereof, said apparatus further comprising means within said canister defining a second chamber within the first chamber, said spark gap trigger being disposed within said second chamber and atmospheric isolated from said first chamber.

9. Apparatus as defined in claim 8 further including a gaseous medium in the first chamber.

10. Apparatus as defined in claim 9 wherein the gaseous medium is $FS_6$.

11. Apparatus as defined in claim 8 further including a fluid medium within said first chamber.

12. Apparatus as defined in claim 8 further including means for venting said second chamber to ambient atmosphere.

13. Apparatus as defined in claim 8 wherein the second chamber is filled with a pressurized gaseous medium including oxygen and is sealed.

14. Apparatus as defined in claim 1 wherein the charge generator is a spiral wrapped capacitor comprising alternate concentric layers of conductive and dielectric material.

15. Apparatus as defined in claim 14 further including conductor means connected between the conductive layers essentially midway along the length thereof and said spark gap trigger.

16. Apparatus as defined in claim 11 wherein said fluid medium is oil.

* * * * *